US007015777B2

(12) United States Patent
Gonin et al.

(10) Patent No.: US 7,015,777 B2
(45) Date of Patent: Mar. 21, 2006

(54) SWITCH DEVICE FOR OPENING AND CLOSING AT LEAST ONE ELECTRICAL LINE

(75) Inventors: Pascal Gonin, Frontonas (FR); Patrice Becavin, Villefontaine (FR); Jean-Pierre Charreton, Saint-Symphorien d'Ozon (FR)

(73) Assignee: Radiall, Rosny-Sous-Bois (FR)

( * ) Notice: Subject to any disclaimer, the term of this patent is extended or adjusted under 35 U.S.C. 154(b) by 126 days.

(21) Appl. No.: 10/396,728

(22) Filed: Mar. 25, 2003

(65) Prior Publication Data

US 2004/0000980 A1 Jan. 1, 2004

(30) Foreign Application Priority Data

Mar. 28, 2002 (FR) ..... 02 03908

(51) Int. Cl.
*H01H 53/00* (2006.01)

(52) U.S. Cl. ..... 335/4; 333/105

(58) Field of Classification Search ..... 333/104–109, 333/258–259; 335/4–5, 132, 165–190, 78–86
See application file for complete search history.

(56) References Cited

U.S. PATENT DOCUMENTS 4,496,806 A 1/1985 Maenishi et al.
5,699,030 A * 12/1997 Leikus et al. ..... 335/4

FOREIGN PATENT DOCUMENTS

| | | |
|---|---|---|
| DE | 19834215 | 2/2000 |
| EP | 0 087 372 A | 8/1983 |
| EP | 0 352 884 | 1/1990 |

(Continued)

OTHER PUBLICATIONS

Patent Abstracts of Japan, publication No. 070144489 of Jan. 17, 1995, application No. 05155918 dated Jun. 25, 1993, Tsuka Kazumasa.

(Continued)

*Primary Examiner*—Lincoln Donovan
(74) *Attorney, Agent, or Firm*—Schweitzer Cornman Gross & Bondell LLP

(57) ABSTRACT

The present invention relates to a switch device for opening and closing at least one electrical line, the device comprising:

at least one pair of contact terminals;

at least one drive member each drive member including a contact piece suitable for being displaced axially between a closed position in which the contact piece presses simultaneously against the two contact terminals of said at least one pair, interconnecting them electrically, and an open position in which the contact piece is spaced apart from said two contact terminals; and at least one actuator comprising an actuator element that is movable and suitable for driving said drive member(s);

at least one of the actuator element and the drive member being connected to a stationary portion of said device by means of a generally flexible holding element, which element has at least one region secured to said stationary portion of the device, and at least one region secured to the actuator element or the drive member, which region is suitable for flexing relative to adjacent regions of the holding element so as to enable the actuator element or the drive member to be displaced substantially in rectilinear translation;

wherein said at least one region secured to the actuator element or to the drive member is situated in a non-central region of the holding element.

23 Claims, 7 Drawing Sheets

FOREIGN PATENT DOCUMENTS

| | | | |
|---|---|---|---|
| EP | 0 618 634 | A | 5/1994 |
| EP | 0 670 579 | A | 9/1995 |
| EP | 1 047 089 | A | 10/2000 |
| FR | 1 309 744 | | 11/1962 |
| GB | 682 667 | A | 11/1952 |
| JP | 7 14489 | | 1/1995 |
| JP | 7 211212 | | 8/1995 |

OTHER PUBLICATIONS

Patent Abstracts of Japan, publication No. 07211212 of Nov. 8, 1995, app. No. 06006843 dated Jan. 26, 1994, Nakahata Atsushi.

* cited by examiner

FIG_12
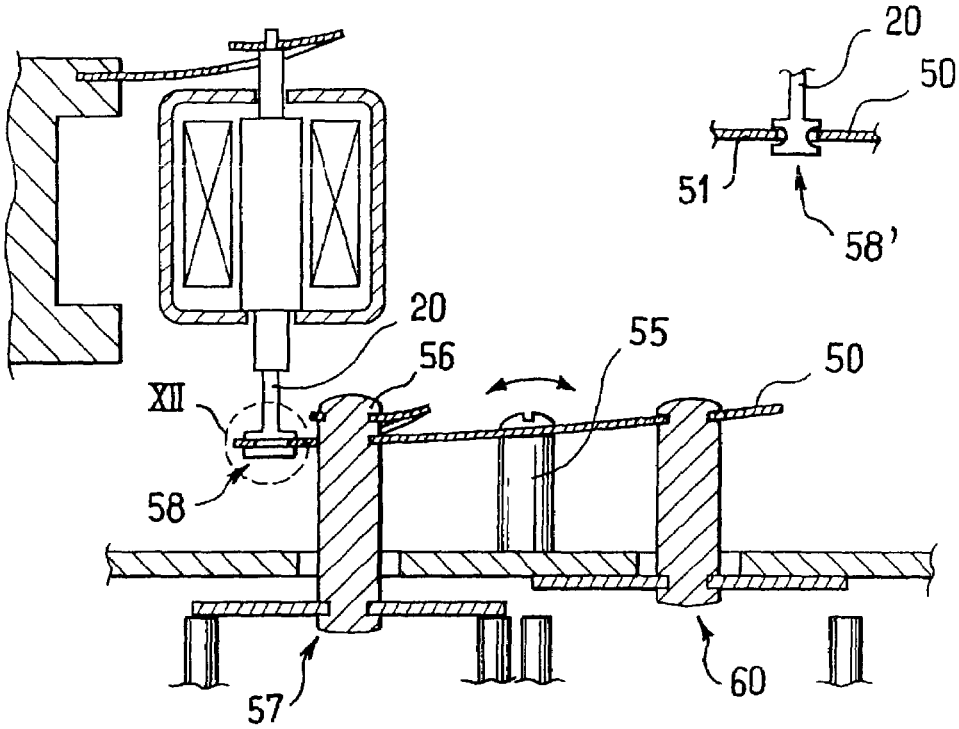
FIG_10
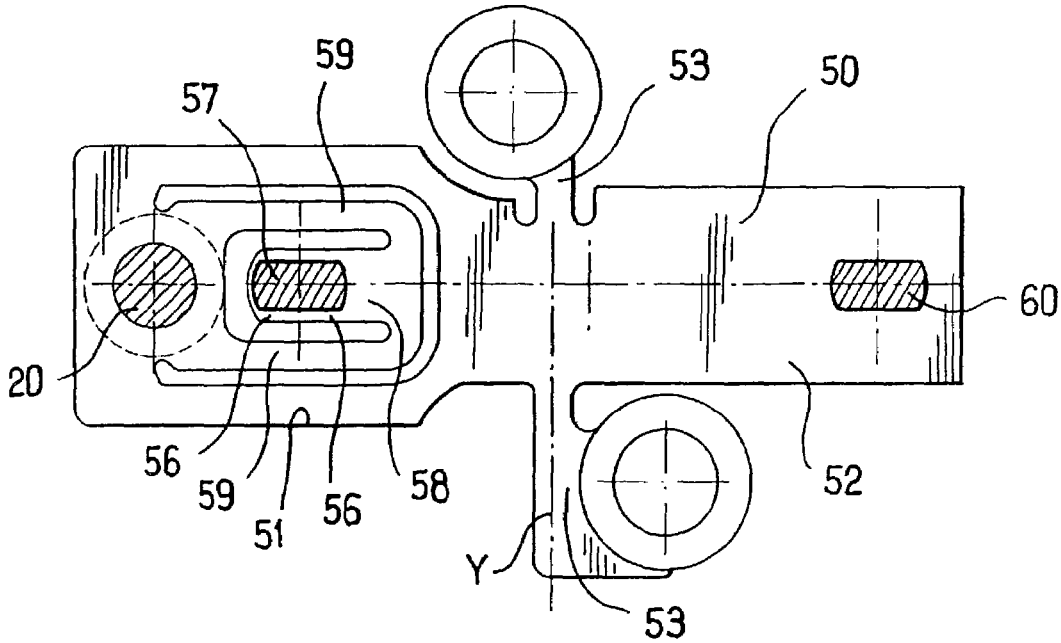
FIG_11

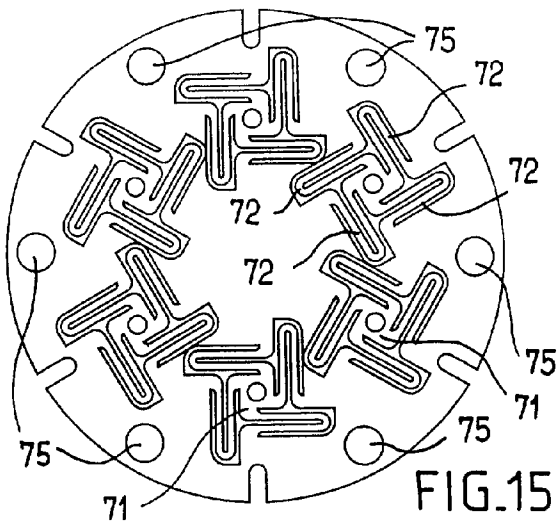
FIG.15
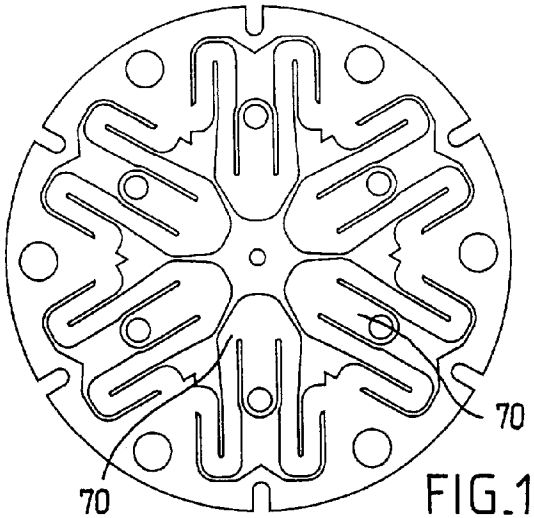
FIG.16
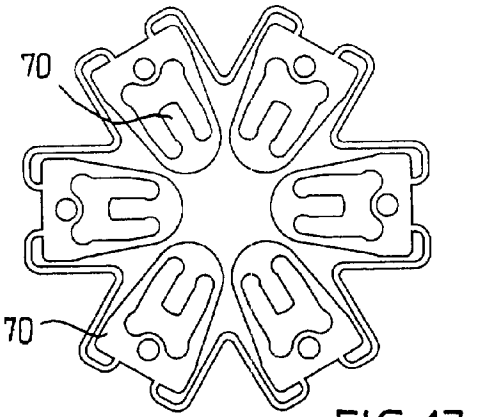
FIG.17
FIG.18
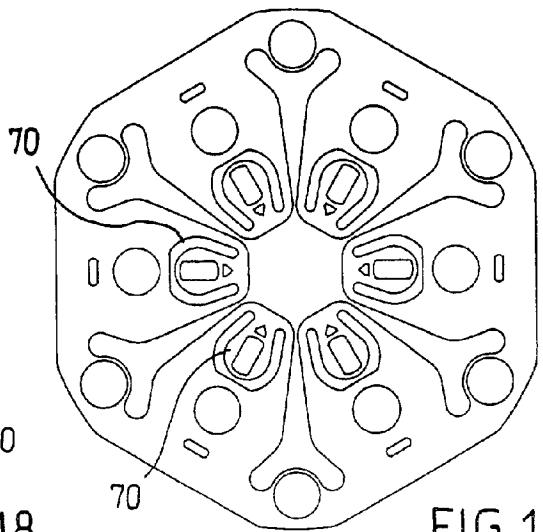
FIG.19
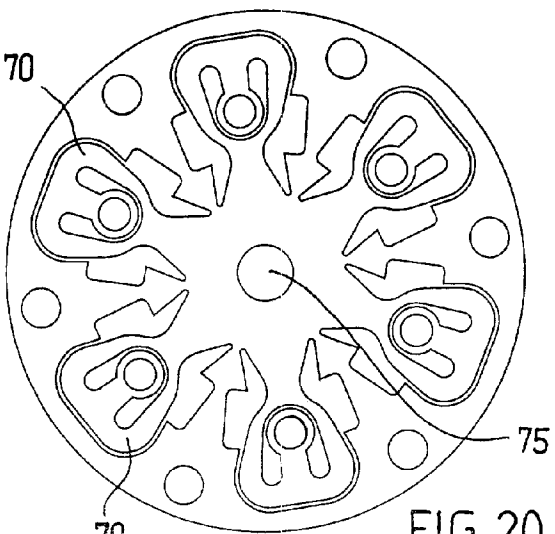
FIG.20

SWITCH DEVICE FOR OPENING AND CLOSING AT LEAST ONE ELECTRICAL LINE

The present invention relates to a switch device for opening and closing at least one electrical line, in particular a high frequency switch suitable for operating equally well with DC signals, low frequency signals, medium frequency signals, and high frequency signals.

BACKGROUND OF THE INVENTION

Switch devices are already known for opening and closing an electrical line in which a blade-shaped contact piece is supported by a drive member that is movable in translation between a position in which said contact piece presses against two contact terminals, thereby closing the electrical line, and a position in which it is spaced apart from said contact terminals, thereby opening the electrical line.

During such movements in translation, the contact piece is guided by rods along which it slides so as to ensure that said contact piece is properly applied against the contact terminals.

Nevertheless, such guidance presents the drawback that the friction which acts between the contact piece and the guide rods generates dust which can become deposited on the electrical contact surfaces and, in the long run, can degrade the reliability of the switch device.

European patent EP 0 670 579 attempts to solve that problem by a switch device comprising a drive member having an axially displaceable contact piece and two parallel flexible blades each presenting a central portion secured to the drive member and two ends each received in a cradle of a stationary support.

That switch device is satisfactory insofar as friction is eliminated with respect to the drive member.

European patent application EP 1 047 089 discloses a coaxial relay having moving blades for opening and closing coaxial contacts. Each of the blades is carried by an actuator fixed at its top end to a return member. The return member has a central branch on which the actuator is fixed, and on either side thereof two lateral branches serving, with the help of screws, to fix the return member to a wall of the relay. Because of the presence of multiple branches, that return member is relatively bulky and cannot be adapted to use in devices of small dimensions.

U.S. Pat. No. 5,471,183 discloses a coaxial switch having connection elements each carried by a dielectric support. The dielectric support is fixed to two superposed return members and is secured to a permanent magnet suitable for co-operating with another magnet carried by a rotor for actuating the corresponding dielectric support. That switch has no actuator coming into contact with the dielectric support in order to move it. In addition, because the dielectric support is fixed to the two blades, that support presents height that is relatively large, thereby making the switch more bulky.

There exists a need to further improve switch devices, in particular by reducing the number of component parts and by reducing the sizes thereof.

There also exists a need not only to eliminate friction with respect to the drive member, but also friction with respect to an actuator for driving the drive member.

There also exists a need to be able to act simultaneously on a plurality of switches.

OBJECTS AND SUMMARY OF THE INVENTION

An object of the present invention is to satisfy some or all of the above needs.

The invention achieves this by means of a switch device for opening and closing at least one electrical line, the device comprising:

at least one pair of contact terminals;

at least one drive member, each drive member including a contact piece suitable for being displaced axially between a closed position in which the contact piece presses simultaneously against the two contact terminals of said at least one pair, interconnecting them electrically, and an open position in which the contact piece is spaced apart from said two contact terminals; and at least one actuator comprising an actuator element that is movable and suitable for driving said drive member(s);

wherein at least one of the actuator element and the drive member is connected to a stationary portion of said device by means of a generally flexible holding element, which element has at least one region secured to said stationary portion of the device, and at least one region secured to the actuator element or the drive member, which region is suitable for flexing relative to adjacent regions of the holding element so as to enable the actuator element or the drive member to be displaced substantially in rectilinear translation.

The "suitability of the region secured to the actuator element or to the drive member for flexing relative to adjacent regions" means that this region is suitable for flexing in a manner that is substantially independent of any flexing to which adjacent regions might be subjected. This enables said region to move relative to the adjacent regions in such a manner as to guide the actuator element or the drive member in displacement that is substantially in rectilinear translation.

By means of the invention, when the flexible holding element includes a flexible return blade secured to an insulating pusher of a drive member, then the flexible return blade can be a single blade, unlike the device described in above-mentioned European patent EP 0 670 579 which has two parallel flexible blades.

The number of parts can thus be reduced and the device can be made at lower cost and can be easier to assemble.

The height of the insulating pusher can also be reduced.

The invention is thus particularly suitable for devices of relatively small dimensions.

In an embodiment of the invention, the holding element comprises at least one flexible blade having a tongue cut out therein, which tongue is preferably likewise flexible.

When the drive member or the actuator element to which the tongue is fixed is driven in displacement, the combination of flexing movement of the blade together with flexing movement of the tongue makes it possible to obtain displacement of the actuator element or of the drive member that is substantially in rectilinear translation.

During displacement of the actuator element or of the drive member, the tongue can thus retain a position that is substantially perpendicular to the displacement direction.

In the present invention, the blade may be substantially elongate in shape and the region of the blade that is secured to a fixed portion of the device and the above-mentioned tongue can be situated at opposite longitudinal ends of the blade. Thus, the blade may be secured to a stationary portion of the device at one end only, thereby increasing the options for fixing the blade to a stationary portion of the device, e.g. to the frame thereof.

In general, the region of the holding element secured to the actuator element or to the drive member is advantageously situated in a non-central region of the holding element.

The above-mentioned tongue may have a longitudinal axis and may be connected to the remainder of the blade at a single longitudinal end.

The above-mentioned tongue is advantageously connected to the remainder of the blade in a region thereof adjacent to a free end of the blade.

As mentioned above, the flexible holding element may comprise a flexible return blade secured to an insulating pusher of a drive member, and the device may further comprise an electrically conductive closure plate provided with an orifice allowing the pusher to pass therethrough, said orifice advantageously presenting a section that is selected in such a manner as to allow the pusher to pass through and move axially without friction.

The holding element may be substantially plane in the rest position.

In an embodiment of the invention, the flexible return blade is suitable for exerting an elastic return force that is sufficient to ensure that in the absence of a drive command on the actuator element, the contact piece comes to bear against the closure plate.

In a variant, the flexible return blade is configured in such a manner that in the absence of a drive command on the actuator element, the contact piece is situated in an intermediate position, between the closed position and a position pressing against the closure plate.

In another variant, the flexible return blade is configured in such a manner that in the absence of a drive command on the actuator element, the contact piece comes to bear against the corresponding contact terminals, i.e. it occupies the closed position.

In a particular embodiment of the invention, the flexible return blade is suitable for being connected directly to the actuator element, thus enabling the number of pieces to be further reduced.

In this embodiment, the absence of the above-mentioned flexible return blade presents the advantage, when a drive member is fixed thereto, that any difference in axial displacement between the drive member and the actuator element which acts on said return blade can be compensated by deformation of the flexible return blade.

If the actuator element were to transmit axial displacement to the drive member over a stroke that is longer than the length between its open position and its closed position, that could lead to the drive member or the actuator element being damaged.

Conversely, if the actuator element were to transmit displacement of amplitude that is too small to the drive member, that could lead to the contact piece being applied poorly against the contact terminals and to the electrical line being improperly closed.

Thus, by means of the return blade, it is possible to use an actuator element which deliberately presents excess travel relative to the length that is to be followed by the drive member, so as to guarantee that the drive member is moved over a length which is sufficient to ensure good electrical contact, while still preserving the drive member and the actuator element from any risk of damage.

The flexible return blade and the actuator element may co-operate by means of a connection that is of the rigid or of the non-rigid type.

The flexible return blade may include a tongue to which the actuator element is fixed, in addition to the tongue to which the drive member is fixed.

In another embodiment of the invention, the actuator element is suitable for acting on the drive member via a flexible control blade that is distinct from said return blade, said control blade possibly including a tongue that comes to bear against the pusher of the drive member.

The presence of the tongue on the control blade, if any, makes it possible to exert on the drive member a force that is directed parallel to the rectilinear displacement direction of the drive member.

Interposing a flexible control blade between the actuator element and the drive member presents the above-mentioned advantage that any difference in axial travel between the actuator element and the drive member can be compensated by deforming the flexible control blade.

In an embodiment of the invention, the actuator element has a top axial end and a bottom axial end, the top end at least being connected to an above-mentioned flexible holding element.

Thus, the actuator element need no longer be guided in sliding via bearings, but may be suspended to one or more flexible holding elements, thus making it possible to avoid any friction between the actuator element and fixed portions of the device, and thus avoiding the appearance of dust which can harm operation of the device.

In an embodiment of the invention, the bottom end of the actuator element is also connected to a flexible holding element.

When the device has at least two drive members for two electrical lines, the device may have a flexible control blade suitable for acting simultaneously or in alternation on said at least two drive members.

The above-mentioned control blade may be used as a return blade for the two drive members, presenting two portions situated on either side of regions for fixing the control blade to stationary portions of the device, each of the two portions being secured to a drive member, and the actuator element is suitable for acting on one of said two portions of the blade in such a manner as to drive one of the two drive members towards the open position and the other towards the closed position.

In a variant, the control blade has two portions situated on either side of regions for fixing the control blade to stationary portions of the device, each of said two portions of the blade being suitable for acting on a corresponding drive member, the actuator element being fixed to the control blade in one of said two portions and each of said drive members being secured to a respective return blade distinct from the control blade.

In an embodiment of the invention, the device includes a flexible holding element provided with a plurality of blades each enabling a drive member or an actuator element to be fixed, the holding element presenting, in particular, a shape that remains invariant on being turned through an angle of $2\pi/n$, where n is an integer, e.g. equal to 6, about an axis of rotation perpendicular to the plane of the blades.

The plurality of blades may be replaced by fixing portions of the actuator element of to the drive member each connected to the remainder of the holding element by a plurality of bridges of material disposed thereabout.

BRIEF DESCRIPTION OF THE DRAWINGS

The invention will be better understood on reading the following detailed description of non-limited embodiments, and on examining the accompanying drawings, in which:

FIG. 10 is a fragmentary diagrammatic axial section view of a switch device constituting another embodiment of the invention;

FIG. 11 is a fragmentary diagrammatic plan view of the control blade of the FIG. 10 device;

FIG. 12 is a fragmentary diagrammatic view of a detail XII showing a variant embodiment of the FIG. 10 device;

FIGS. 15 to 20 are fragmentary diagrammatic plan views of flexible holding elements constituting different embodiments of the invention.

MORE DETAILED DESCRIPTION

Figure 1:
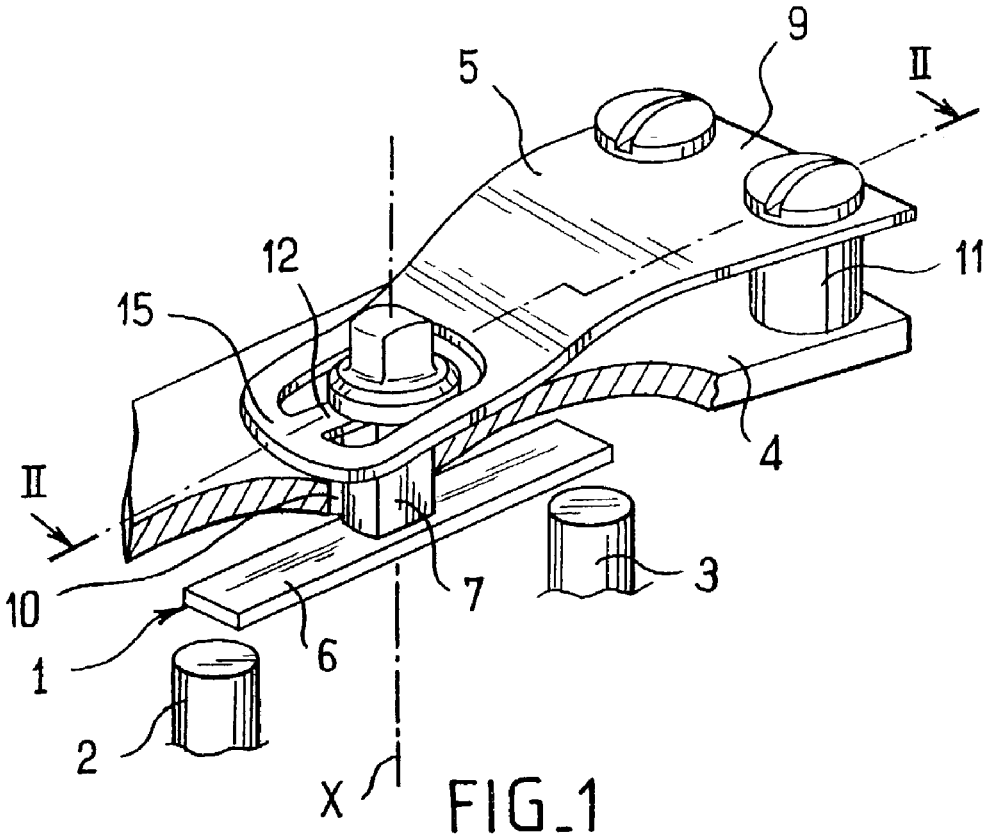
FIG. 1 is a fragmentary diagrammatic perspective view of a switch device of the invention, with some of the closure plate material cut away.

FIG. 1 shows certain elements of a switch device for opening and closing an electrical line.

These elements include a drive member 1, two contact terminals 2 and 3, a plate 4 for closing a conductive body, and a flexible return blade 5.

The drive member 1 comprises a contact piece 6 in the form of a metal blade that is substantially rectangular and electrically conductive.

This contact piece 6 is fixed to an electrically insulating pusher 7.

In the example described, the pusher 7 and the contact piece 6 are assembled together by a mortise and tenon type connection with flattened material, as described in patent EP 0 670 579.

The contact piece 6 is suitable for pressing simultaneously against the two contact terminals 2 and 3 in the closed position.

Figure 2:
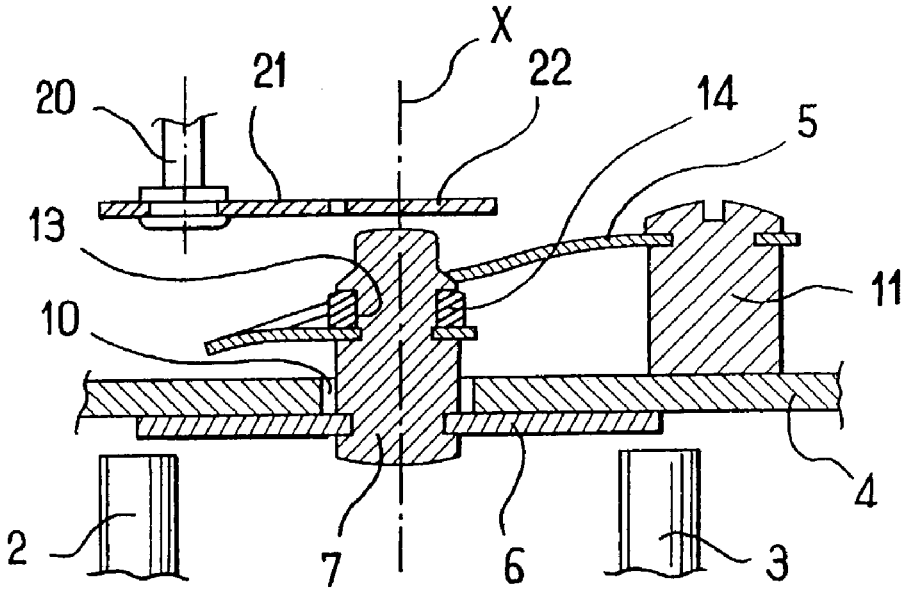
FIG. 2 is a fragmentary diagrammatic section view on II—II showing the FIG. 1 device fitted with an actuator element secured to a control blade.

The closure plate 4 providing electromagnetic shielding relative to the outside environment includes an orifice 10 enabling the pusher 7 to pass through and move axially without friction along an axis X, as can be seen in FIG. 2 in particular.

The flexible return blade 5 is generally trapezoidal in shape when seen from above. This blade 5 has a connection region 9 situated beside the large base of the trapezoid and fixed to two studs 11 mounted on the closure plate 4.

The flexible return blade 5 has a tongue 12 engaged in a groove 13 of the pusher 7 and held therein by a split ring 14.

In the example described, the pusher 7 is substantially rectangular in cross-section and the tongue 12 presents an orifice of corresponding shape so as to provide an anti-rotation connection between the pusher 7 and the blade 5.

The tongue 12 is made within the blade 5 and it is connected to the remainder of the blade 5 via a region 15 adjacent to the free end of the blade 5, remote from its connection region 9.

Thus, when the drive member 1 is driven in displacement, the tongue 12 can flex relative to the remainder of the blade 5, while the blade 5 can itself flex relative to the studs 11.

This combination of flexing movements ensures that the drive member 1 moves substantially rectilinearly along the axis X.

The blade 5 thus enables the drive member to be positioned reliably and accurately in a plane parallel to the closure plate 4, thereby significantly reducing the risk of contact between the pusher 7 and the wall of the orifice 10.

In the example of FIGS. 1 and 2, the return blade 5 is prestressed.

In this way, the blade 5 continuously exerts a return force directed upwardly along the axis X on the pusher 7 so that the contact piece 6, when in the open position, presses against the closure plate 4.

Figure 3:
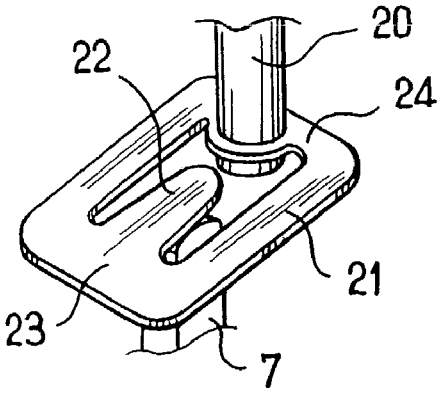
FIGS. 3 and 4 are fragmentary diagrammatic perspective views showing a detail of FIG. 2, the control blade being respectively in a rest position and in a position bearing against the drive member.
Figure 4:
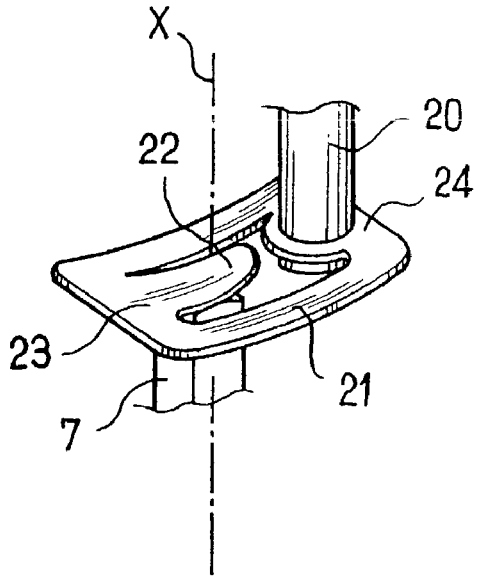

In the example described, the pusher 7 is driven in displacement by means of an actuator element 20 shown in part in FIG. 2, with a flexible control blade 21 fixed to the bottom end thereof, as can be seen more clearly in FIGS. 3 and 4.

The flexible control blade 21 has a tongue 22 connected to the remainder to the blade 21 in a region 23 situated at its end opposite from a region 24 where the blade 21 is connected to the actuator element 20.

The actuator element 20 is suitable for driving the drive member 1 from an open position in which the contact piece 6 presses against the closure plate 4, as shown in FIG. 2, towards a position in which the electrical line is closed, this being done by means of the tongue 22 pressing against the pusher 7, as shown in FIG. 4.

The tongue 22 then takes up a position substantially perpendicular to the axis X and exerts a thrust force on the pusher 7 substantially parallel to the axis X.

The presence of the flexible control blade 21 makes it possible to use an actuator element 20 whose axial displacement is slightly too great compared with that of the drive member 1, thereby making it possible to guarantee good contact between the contact piece 6 and the contact terminals 2 and 3.

In the example described, the blade 5 comprises only portions that are solid, with the exceptions of the cutout made around the tongue 12 and of the orifices for fixing to the studs 11.

In a variant, the blade 5 can have an additional opening configured so as to make it more flexible.

It would not go beyond the ambit of the present invention for the actuator element 20 to be fixed directly to the flexible return blade without interposing a control blade.

Figure 7:
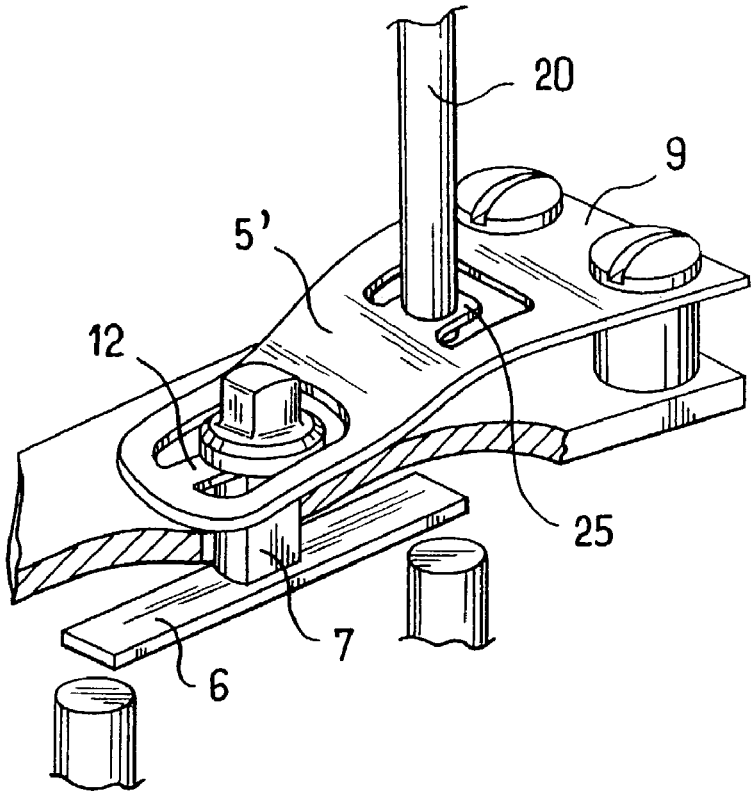
FIG. 7 is a fragmentary diagrammatic view of a variant embodiment of the FIG. 1 device.

FIG. 7 shows a flexible return blade 5' that is substantially analogous to the return blade 5, except that it differs from the blade 5 by the fact that it has a second tongue 25.

The tongue 25 is made within the return blade 5' and is connected to a region thereof that is remote from its connection region 9, like the flexible blade 12.

The actuator element 20 is described in greater detail below.

Figure 5:
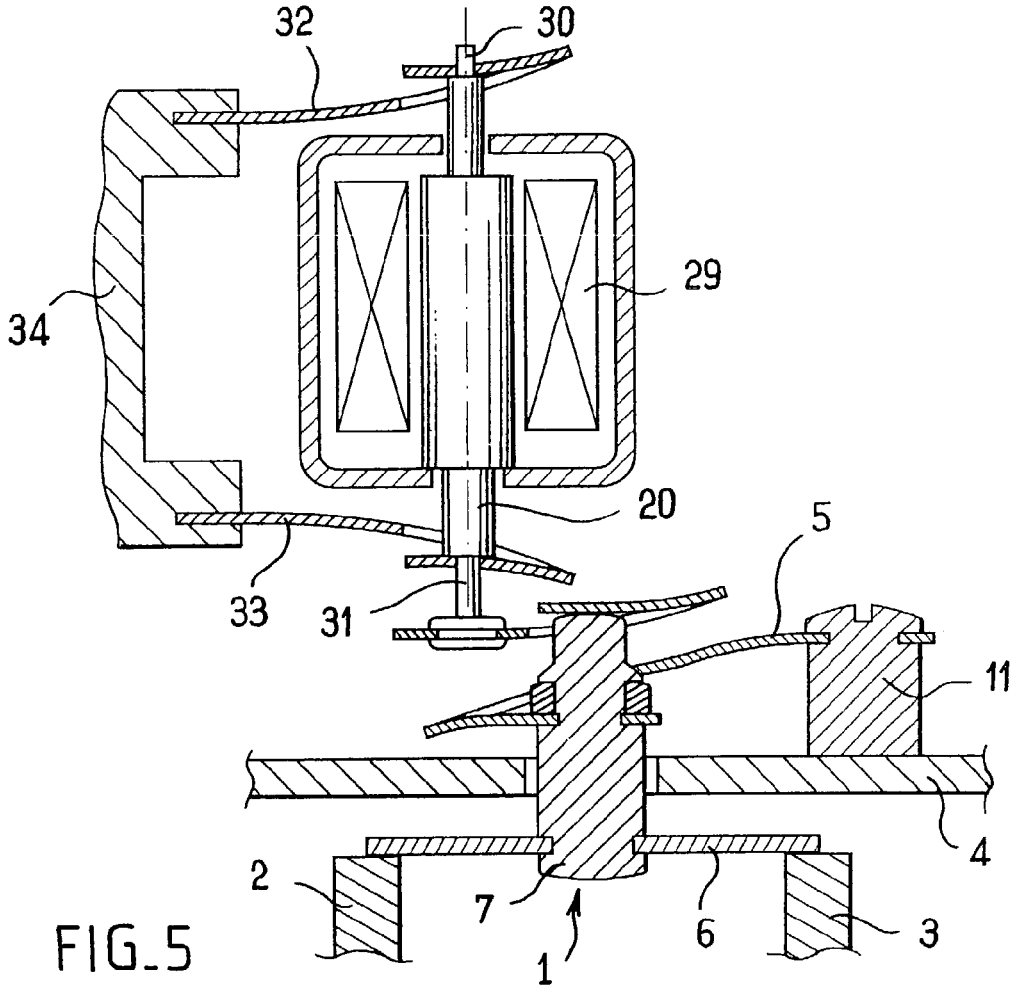
FIG. 5 is a fragmentary diagrammatic axial section view of a switch device of the invention including an actuator element having both its axial ends suspended from flexible blades.

The actuator element 20 constitutes the moving portion of an electromagnetic type actuator that is driven in displacement by a coil 29 fixed relative to the switch device, as shown very diagrammatically in FIG. 5, where the drive member is shown in the closed position.

The coil 29 is connected to the remainder of the switch device by fixing means (not shown).

In general, the electromagnetic actuator can optionally be of the polarized type.

The actuator element 20 has its top and bottom portions 30 and 31 fixed to respective flexible holding blades 32 and 33.

Each of these blades 32 and 33 has one end secured to a stationary portion 34 of the switch device, for example a frame.

Figure 6:
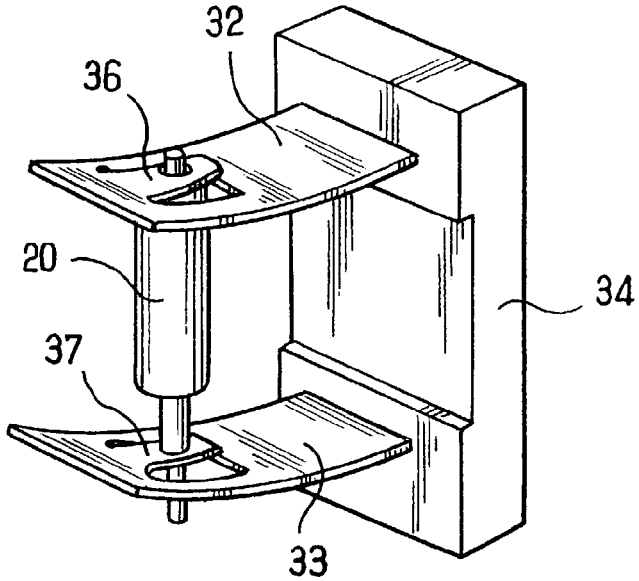
FIG. 6 is a fragmentary diagrammatic perspective view of the actuator of the FIG. 5 device.

As can be seen in FIG. 6 in particular, each of these flexible blades 32 and 33 comprises a respective tongue 36 or 37 fixed to a corresponding end of the actuator element 20.

It would not go beyond the ambit of the present invention for the tongues 36 and 37, or for only one of them, to be replaced merely by a solid portion of the corresponding blade.

The actuator element 20 is thus held in suspension by the two flexible blades 32 and 33 and it does not rub against any stationary portion of the switch device.

Instead of acting on the drive member 1 via a control blade, as shown in FIG. 5, the actuator element 20 can be fixed directly to the return blade 5.

Figure 8:
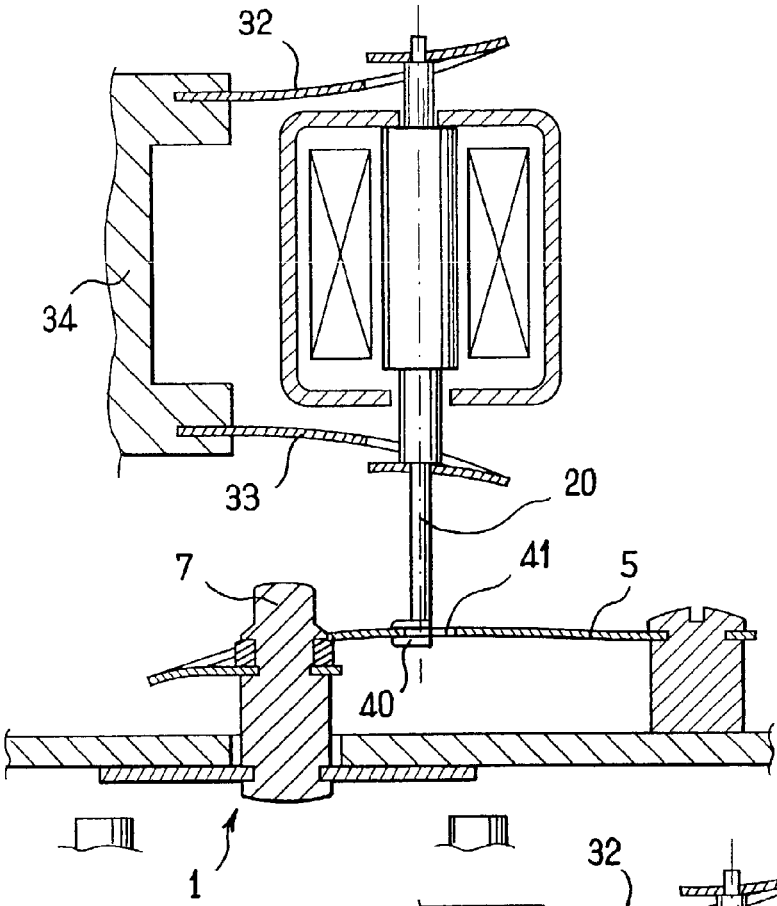
FIG. 8 is a fragmentary diagrammatic axial section view of a switch device constituting another embodiment of the invention.

In the embodiment shown in FIG. 8, the actuator element 20 has a bottom groove 40 and the return blade 5 has an orifice 41 enabling the blade 5 to be engaged in the groove 40.

The orifice 41 is of section selected to allow clearance between the actuator element 20 and the blade 5 in the plane of the blade 5.

In other words, the connection between the actuator element 20 and the return blade 5 is not rigid, and serves essentially to drive vertical displacement of the blade 5.

Displacement in rectilinear translation of the actuator element 20 is ensured by the presence of the blades 32 and 33.

The actuator element 20 and the blade 5 can also be configured in such a manner as to be interconnected by a ball-and-socket joint, e.g. obtained by having a groove 40 which presents not only the above-mentioned clearance in the plane of the blade 5, but also axial clearance between the blade 5 and the groove 40 presenting a depth that is greater than the thickness of the blade 5.

Figure 9:
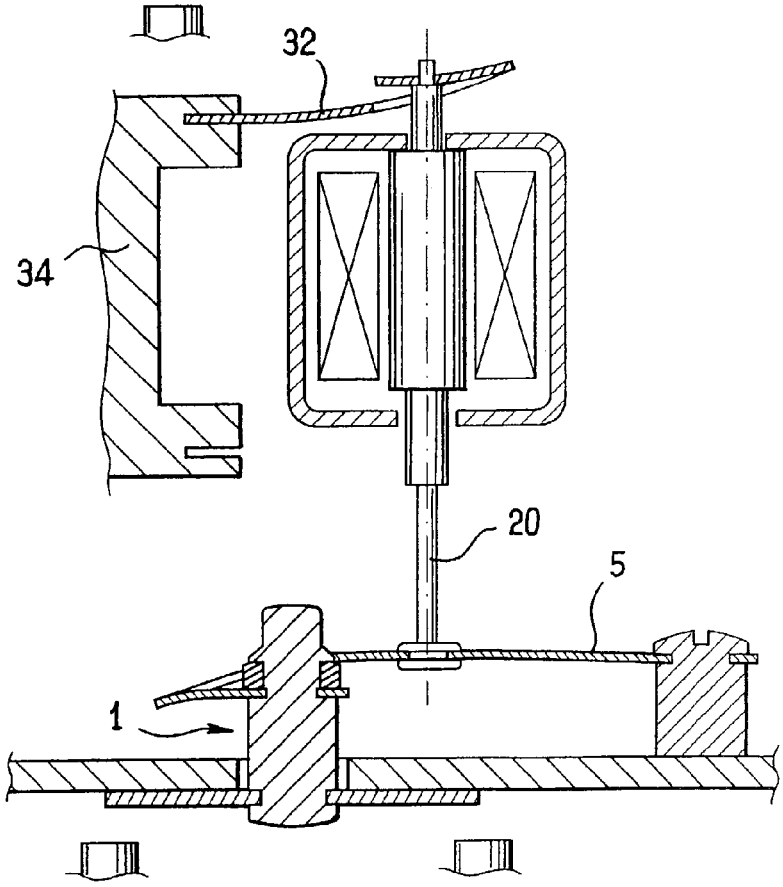
FIG. 9 is a fragmentary diagrammatic axial section view of a variant of the FIG. 8 embodiment of a switch device.

In a variant, as shown in FIG. 9, the connection between the actuator element 20 and the blade 5 is rigid.

The bottom holding blade 33 is then no longer needed in this embodiment.

It would not go beyond the ambit of the present invention to make a connection of a different type between the actuator element 20 and the blade 5, providing the connection enables the blade 5 to be driven vertically.

In the embodiment described above, the control blade acts on a single drive member.

It would not go beyond the ambit of the present invention for the control blade to act on two drive members, either simultaneously or in alternation.

FIG. 10 shows a switch device having a control blade 50 comprising two portions 51 and 52 of generally rectangular shape situated on either side of portions 53 for fixing the blade 50 to stationary studs 55.

As can be seen in FIG. 11, the rectangular portion 51 on the left has a tongue 56 to which a drive member 57 is fixed, said tongue 56 being connected to the remainder of the rectangular portion 51 via two prongs 59.

The actuator element 20 is fixed to the rectangular portion 51 via a rigid connection 58 by being engaged in a groove of the actuator element.

This rigid connection 58 may be implemented in particular by means of a screw, by crimping, or by adhesive, this list not being limiting.

The second drive member 60 is fixed to the rectangular portion 52 on the right in FIGS. 10 and 11.

In the example described, the portion 52 does not have a tongue made within it.

In a variant that is not shown, the region 52 could have a tongue made therein, which tongue would be fixed to the drive member 60.

In a variant shown in FIG. 12, the actuator element 20 and the portion 51 co-operate via a ball-and-socket connection 58', in which case it is necessary for the bottom portion of the actuator element 20 to be fixed to a flexible blade, as is shown in FIG. 8.

When the actuator element 20 is caused to move downwards, as shown in FIG. 10, the control blade 50 acts via the tongue 56 to exert a downwardly-directed thrust force on the drive member 57 so as to bring it into its closed position.

Simultaneously, in order to tilt about an axis Y between the portions 51 and 52, the portion 52 drives the drive member 60 upwards into its open position where it presses against the closure plate.

This provides a device using a single actuator element 20 for driving two drive members in opposite travel directions so as to obtain alternate opening and closing of electrical lines.

In the example described, the control blade 50 thus also serves as a return spring for the drive members 57 and 60.

Figure 13:
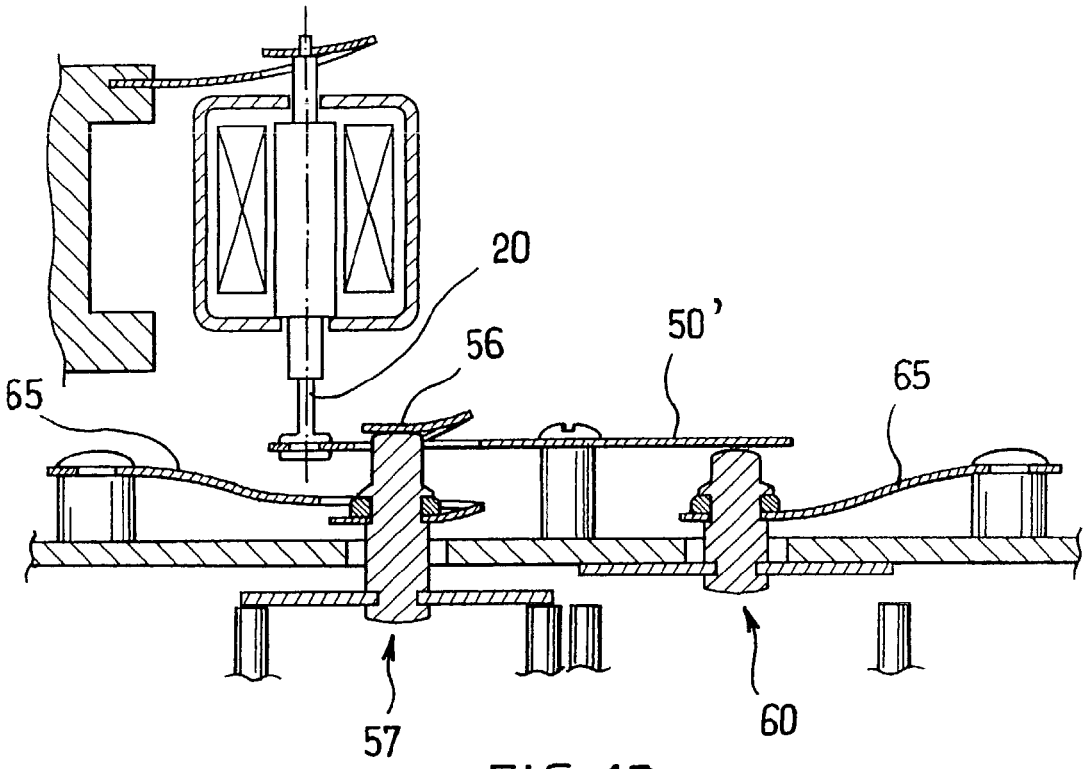
FIG. 13 is a fragmentary diagrammatic axial section view of a switch device constituting another embodiment of the invention.
Figure 14:
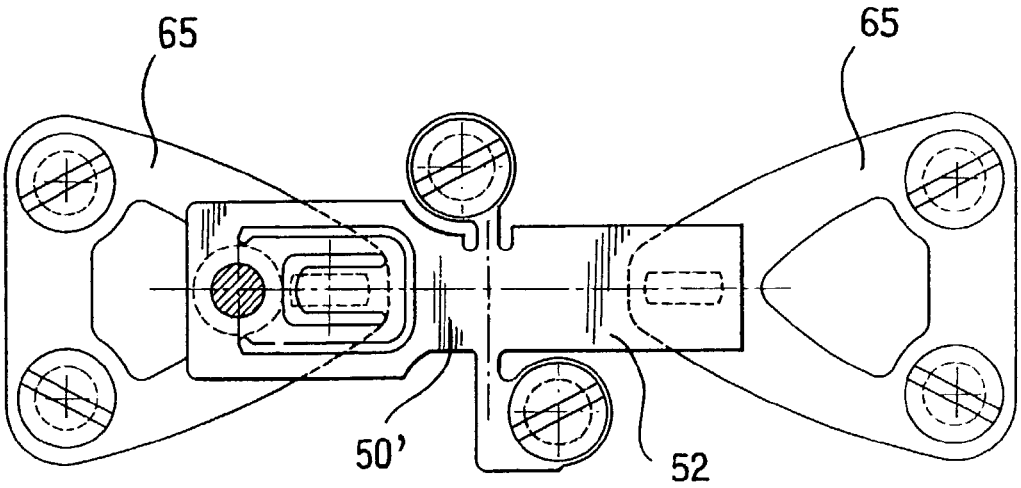
FIG. 14 is a fragmentary diagrammatic plan view of the return and control blades of the FIG. 13 device.

In a variant, as shown in FIGS. 13 and 14, each of the drive members 57 and 60 is connected to corresponding stationary portions of the device via respective return blades 65 substantially analogous to the above-described return blade 5.

The device has a control blade 50' that is generally analogous to the control blade 50, but that is not secured to the drive members 57 and 60.

When the actuator embodiment 20 is caused to move downwards, the tongue 56 comes to bear against the drive member 57 and drives it downwards against the return force exerted by the return blade 65.

Simultaneously, the region 52 of the blade 50' tilts upwards so as to enable the drive member 60 to be driven upwards into the open position, under the return force exerted by the return blade 65.

It would not go beyond the ambit of the present invention to provide the switch device with flexible elements, each comprising return blades for a plurality of drive members, control blades for a plurality of drive members, or holding elements for a plurality of actuator elements.

FIGS. 15 to 20 show such flexible elements constituting various embodiments of the invention.

Each of the flexible elements described with reference to FIGS. 16 to 20 comprises six flexible blades 70 each of which can have a drive member (FIGS. 16, 18, 19, 20) or an actuator element (FIGS. 16, 17, 18, 19, 20) fixed thereto.

The flexible element of FIG. 15 does not have any flexible blades, but instead has portions 71, each connected to the remainder of the flexible element via four bridges of material 72 that are U-shaped and that are disposed around a portion 71.

Each portion 71 is thus free to move axially relative to the remainder of the flexible element with which it is connected.

The above-mentioned flexible elements may present symmetry of revolution, i.e. they may be of a shape that leaves the element invariant after being turned through an angle of $2\pi/6$ about an axis perpendicular to the plane of the blades.

A switch device may be made with two of the above-described flexible elements that are superposed, one being secured to actuator elements and including control blades 70, and the other being secured to drive members and including return blades 70.

The above-mentioned flexible elements may be fixed to a stationary portion of the device via studs engaged in openings 75 of the flexible elements.

There may be six such openings 75 situated at the periphery of a flexible element, which would require the presence of six studs, as shown in FIG. 15.

In a variant, the flexible element may have a single central opening 75 for fixing to a single stud, as shown in FIG. 20.

The flexible elements comprising a plurality of blades may be used for switches of the SPnT type, for example.

Naturally, the invention is not limited to the embodiments described above.

The flexible elements shown in FIGS. 15 to 20 could have some other number of blades, greater than or less than six.

What is claimed is:

1. A switch device for opening and closing at least one electrical line, the device comprising:

at least one stationary portion, at least one pair of contact terminals;

at least one drive member comprising a contact piece suitable for being displaced axially between a closed position in which the contact piece contacts simultaneously the two contact terminals of said at least one pair, interconnecting them electrically, and an open position in which the contact piece is spaced apart from said two contact terminals;

at least one actuator comprising an actuator element that is movable and suitable for driving said at least one drive member;

a generally flexible holding element connecting at least one of the actuator element and the drive member to said stationary portion of the device, said holding element having at least one first region secured to said stationary portion, and at least one second region secured to the at least one of the actuator element and the drive member, said second region being suitable for flexing relative to at least one adjacent region of the holding element so as to enable the at least one of the actuator element and the drive member to be displaced substantially in rectilinear translation;

wherein said at least one second region is a non-central region of the holding element.

2. A device according to claim 1, wherein the holding element comprises at least one flexible blade provided with a tongue cut out in said blade.

3. A device according to claim 2, wherein the tongue is connected to a remainder of the blade in a region thereof that is adjacent to a free end of the blade.

4. A device according to claim 2, wherein the drive member comprises an insulating pusher secured to said tongue of the holding element.

5. A device according to claim 4, comprising an electrically conductive closure plate having an orifice allowing said pusher to pass therethrough, wherein said orifice has a section selected in such a manner as to allow the pusher to pass through and move axially without friction.

6. A device according to claim 4 or 5, wherein the flexible holding element is configured for exerting a resilient return force that is sufficient to ensure that in the absence of a drive command being applied to the actuator element the contact piece bears against the closure plate.

7. A device according to claim 4 or 5, wherein the holding element is configured in such a manner that in the absence of a drive command being applied to the actuator element, the contact piece is situated in an intermediate position between its closed position and a position in which it bears against the closure plate.

8. A device according to claim 4 or 5, wherein the flexible holding element is configured in such a manner that in the absence of a drive command applied to the actuator element, the contact piece is in its closed position.

9. A device according to claim 1, wherein the holding element is secured both to the actuator element and the drive element.

10. A device according to claim 9, wherein the holding element and the actuator element are rigidly connected.

11. A device according to claim 9, wherein the holding element and the actuator element are non-rigidly connected.

12. A device according to claim 9, wherein the holding element comprises a flexible return blade with a tongue secured to the actuator element.

13. A device according to claim 4, wherein the actuator element is configured for acting on the drive member via a flexible control blade distinct from the holding element.

14. A device according to claim 1, wherein the actuator element has an axial top end and an axial bottom end, the top end at least being connected to a flexible holding element.

15. A device according to claim 14, wherein the bottom end of the actuator element is connected to a flexible holding element.

16. A device according to claim 1, having at least two drive members, the device including a flexible control blade suitable for acting simultaneously or in alternation of said at least two drive members.

17. A device according to claim 16, wherein the control blade is configured as a return blade for the two drive members, the blade presenting two portions situated on either side of fixing regions for fixing the return blade to stationary portions of the device, each of the two portions of the blade being secured to a respective drive member, and wherein the actuator element is suitable for acting on one of said two portions so as to drive one of the two drive members towards the open position and the other towards the closed position.

18. A device according to claim 16, wherein said control blade has two portions situated on either side of regions for fixing the control blade to fixed portions of the device, each of said two portions of the blade being suitable for acting on a corresponding drive member, the actuator element being fixed to the control blade in one of said two portions, and wherein each of the drive members is secured to a respective return blade distinct from the control blade.

19. A device according to claim 1, including a flexible holding element provided with a plurality of blades, each enabling a drive member or an actuator element to be fixed, the holding element presenting in particular a shape that is invariant on being turned through an angle of 2□/n, where n is an integer, about an axis of rotation perpendicular to the plane of the blades.

20. A device according to claim 13, wherein said control blade comprises a tongue configured for bearing against the insulating pusher of the drive member.

21. A switch device for opening and closing at least one electrical line the device comprising:

at least one stationary portion, at least one pair of contact terminals;

at least one drive member comprising a contact piece suitable for being displaced axially between a closed position in which the contact piece contacts simultaneously the two contact terminals of said at least one pair, interconnecting them electrically, and an open position in which the contact piece is spaced apart from said two contact terminals;

at least one actuator comprising an actuator element that is movable and suitable for driving said at least one drive member when the actuator element is displaced, a generally flexible holding element connecting at least one of the actuator element and the drive member to said stationary portion of the device said holding element having at least one first region secured to said stationary portion, and at least one second region secured to the at least one of the actuator element and the drive member, said second region being suitable for flexing relative to at least one adjacent region of the holding element so as to enable the at least one of the actuator element and the drive member to be displaced substantially in rectilinear translation;

wherein the second region of the holding element comprises a flexible tongue, said tongue having two opposite ends, said tongue being connected to a remainder of the holding element at only one of said ends.

22. A switch device for opening and closing at least one electrical line, the device comprising:

at least one stationary portion, at least one pair of contact terminals;

at least one drive member comprising a contact piece suitable for being displaced axially between a closed position in which the contact piece contacts simultaneously the two contact terminals of said at least one pair, interconnecting them electrically, and an open position in which the contact piece is spaced apart from said two contact terminals;

at least one actuator comprising an actuator element that is movable and suitable for driving said at least one drive member, a generally flexible holding element connecting the actuator element to said stationary portion, said holding element having at least one first region secured to said stationary portion, and at least one second region holding the actuator element in suspension, said second region being suitable for flexing relative to at least one adjacent region of the holding element so as to enable the actuator element to be displaced substantially in rectilinear translation.

23. A device according to claim 22, comprising at least two substantially flexible holding elements secured to said stationary portion of the device and configured for holding the actuator element in suspension.

* * * * *